United States Patent [19]

Ida

[11] 4,393,903

[45] Jul. 19, 1983

[54] WEFT FEELER UNIT FOR A FLUID-JET LOOM

[75] Inventor: Yoshio Ida, Kanazawa, Japan

[73] Assignee: Tsudakoma Kogyo Kabushiki Kaisha, Japan

[21] Appl. No.: 258,455

[22] Filed: Apr. 29, 1981

[30] Foreign Application Priority Data

Jun. 23, 1980 [JP] Japan ..... 55-85656

[51] Int. Cl.[3] ..... D03D 51/34

[52] U.S. Cl. ..... 139/370.2

[58] Field of Search ..... 139/336, 370.1, 370.2; 66/163; 340/259

[56] References Cited

U.S. PATENT DOCUMENTS 4,041,985 8/1977 Gotoh ..... 139/370.2

4,082,119 4/1978 Washino ..... 139/370.2

*Primary Examiner*—Henry S. Jaudon

*Attorney, Agent, or Firm*—Ostrolenk, Faber, Gerb & Soffen

[57] ABSTRACT

On a electrode pair type weft feeler unit for a fluid-jet loom, electric connection between electrodes due to electric discharge to be caused by use of high electric voltage is assimilated to electric connection caused by direct contact of a normally inserted weft with the electrodes in order to enable reliable detection of weft insertion even when a high twist yarn is used for the weft.

10 Claims, 1 Drawing Figure

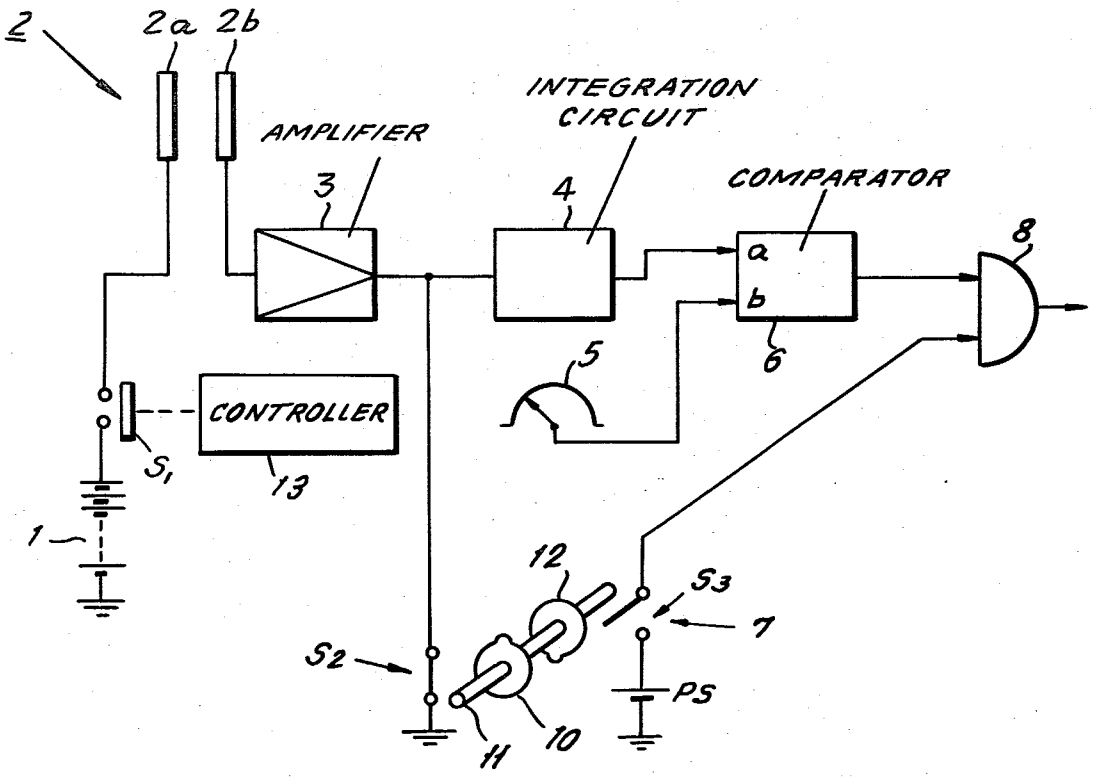
8
COMPARATOR
a
b
6
INTEGRATION CIRCUIT
4
5
AMPLIFIER
3
2b
2a
2
CONTROLLER
13
S1
1
S2
12
10
11
S3
7
PS

WEFT FEELER UNIT FOR A FLUID-JET LOOM

BACKGROUND OF THE INVENTION

The present invention relates to improved weft feeler unit for a fluid-jet loom, and more particularly relates to improvement in the construction of a weft feeler unit which includes, as a detection terminal, a weft feeler made up of a pair of electrodes mounted to the weft arrival side end of a reed on a fluid-jet loom such as a water-jet loom.

It is a usual practice on a fluid-jet loom to arrange a weft feeler on the reed at a position where a normally inserted weft arrives. At every beating, the weft feeler detects the presence of the weft at that position and generates either a normal or an abnormal signal for every weft insertion. The normal signal indicates that the weft in that cycle has been inserted correctly (normal weft insertion) and that the loom should continue running. The abnormal signal indicates that the weft in that cycle has not been inserted correctly (abnormal weft insertion) and that the loom should stop running. These signals are passed to the drive control unit of the loom. One typical example of such a weft feeler unit is disclosed in Japanese Patent Opening No. 70163/1977.

It is well known that the electric resistance of a yarn impregnated with fluid such as water is appreciably high. Consequently, it is desirable to apply a high level of voltage to the electrodes composing the weft feeler of the above-described type in order to obtain high rate of accuracy in weft detection. In other words, such high level of voltage is preferably required in order to ensure that a normal signal will be generated without fail when the weft has been correctly inserted and the electrodes have been bridged by the weft. However, use of such a high level of voltage is liable to cause insultation problems. That is, a high level of voltage tends to form an undesired electric bridge between the electrodes due to the presence of yarn fluffs and/or water drops floating in the space between the electrodes. Further, deterioration in insultation eventuates in dielectric breakdown. These accidents tend to cause the generation of a normal signal even when the weft has actually been inserted incorrectly. In order to obviate this problem, it has been conventionally employed to apply electric voltages of about 500 V to the electrodes composing the weft feeler despite the above-described advantage in use of high level of voltage.

When a high twist yarn is used for a weft, the relatively low hydroscopic property and twist torque of the yarn make the weft whip significantly at the position of the weft feeler, thereby causing incomplete contact of the weft with the electrodes composing the weft feeler. Such incomplete contact disables production of signal current of sufficient magnitude with the above-described conventional level of voltage applied to the electrodes.

Further, fluctuation in the signal current is liable to cause detection errors. That is, even when the weft has come into stable contact with the electrodes, the relatively low level of the output signals disables correct discrimination of the signals. Further, the weft in fact whips in most cases upon contact with the electrodes and this inevitably causes a significant fluctuation in level of the output signals. As a consequence, an abnormal signal is generated to stop the running of the loom even though the weft has been correctly inserted. This naturally results in low rate running efficiency of the loom.

SUMMARY OF THE INVENTION

It is the object of the present invention to provide a weft feeler unit which is capable of, even when a high twist yarn is used for the weft, reliably discerning the success in weft insertion.

In accordance with the basic aspect of present invention, high electric voltage is applied to electrodes composing a weft feeler which is high enough to establish a virtual electric connection between the electrodes and a weft by means of electric discharge as long as the weft has been normally inserted even when the weft actually does not come into contact with the electrodes due to whipping.

More specifically, the weft feeler unit in accordance with the present invention includes a weft feeler made up of a pair of electrodes which are mounted to the reed of the loom on the weft arrival side while being spaced from each other along the traveling path of a weft. This weft feeler is connected to a detection circuit which issues operation signals for the drive control unit of the loom in accordance with the condition of the weft insertion.

In more detail, one electrode is connected to an electric power source supplying the electrodes with a high electric voltage which is high enough to establish a virtual electric connection between the electrodes and the weft by means of electric discharge as long as the weft has been normally inserted even when the weft actually does not come into contact with the electrodes due to whipping. Another electrode is connected to a weft insertion signal generator for selectively generating one of an electric normal, a false normal and an abnormal weft insertion signal at every weft insertion depending on the condition of the weft insertion. This weft insertion signal generator is grounded via a normally closed switch which is opened only when the weft arrives at the position of the weft feeler. A comparator circuit is connected to the output sides of the weft insertion signal generator and to a reference signal generator for generating a threshold electric signal at every weft insertion whose level is between the levels of the normal and false normal weft insertion electric signals. An AND-gate is connected to the output side of the comparator circuit. This AND-gate is connected to a timing signal generator for generating a timing electric signal at every weft insertion at a timing between weft insertion and cloth-fell beating.

In accordance with the preferred embodiment of the present invention, the value of the electric voltage to be applied to the weft feeler should be in a range from 900 to 3,000 V. No electric discharge occurs when the electric voltage falls short of 900 V. When the electric voltage surpasses 3,000 V, electric connection is established between the electrodes by means of electric discharge even in the case of abnormal weft insertion. Further leakage current may flow due to poor insulation.

In accordance with the basic concept of the present invention, electric connection between the electrodes and the weft caused by electric discharge is assimilated to electric connection caused by direct contact of the weft with the electrodes. In order to successfully obviate any troubles to be possibly caused by such assimilation, precautionary measures should preferably be employed in the present invention.

During weft insertion, arrival of the fluid-jet, such as a water-jet, to the position of the weft feeler precedes arrival of the weft at the position. Since high electric voltage is applied to the weft feeler in accordance with the present invention, the water-jet may cause electric discharge despite relatively high resistance of water, thereby establishing an electric connection between the electrodes. In other words, this connects to generation of a normal weft insertion electric signal even when the actual weft insertion has ended in failure.

In accordance with one preferred aspect of the present invention, a normally open switch is arranged between the weft feeler and the electric power source which is closed only when the weft comes to the position of the weft feeler so that a corresponding electric signal is issued by the weft feeler and processed through the detection circuit.

Contact of the normally inserted weft spans the period from the end of the weft insertion to the end of the cloth-fell beating. Since the weft feeler approaches the cloth-fell at the beating moment and, as a result, contacts or approaches close to the weft which was inserted during the preceding cycle. This may generate a normal weft insertion signal even though the weft has been inserted abnormally during the present cycle.

In accordance with one preferred aspect of the present invention, a timing signal is generated in the detection circuit during a period from the end of weft insertion and beginning of cloth-fell beating. This timing signal and the weft insertion signal from the weft feeler are applied to an AND-gate which generates an operation signal for the drive control unit of the loom when enabled.

DESCRIPTION OF THE DRAWING

The accompanying drawing is block diagram for showing the construction of one preferred embodiment of the weft feeler unit in accordance with the present invention.

DESCRIPTION OF THE PREFERRED EMBODIMENT

In the arrangement shown in the drawing, a weft feeler 2 is made up of a pair of spaced electrodes 2*a* and 2*b* fixed to the reed of the loom on the arrival side of the weft whilst facing the advancing path of the weft. The weft feeler 2 is connected to a detection circuit which applies, depending on the condition of weft insertion, either normal or abnormal signal to the drive control unit of the loom.

More specifically, the one electrode 2*a* is connected to an electric power source 1 via a switch $S_1$ whereas the other electrode 2*b* is connected to the input terminal of an integration circuit 4 via an amplifier 3. One contact of a switch $S_2$ is connected to the output line of the amplifier 3 whereas another contact of the switch $S_2$ is grounded. The output terminal of the integration circuit 4 is connected to one input terminal a of a comparator 6 whereas another input terminal b of the comparator 6 is connected to the output terminal of a potentiometer 5. The output terminal of the comparator 6 is connected to one input terminal of an AND-gate 8 whereas another input terminal of the AND-gate 8 is connected to the output terminal of a timing signal generator 7.

With the above-described construction, the weft feeler unit in accordance with the present invention operates as follows. In the following description, it is assumed that a normally open switch is used for the first switch $S_1$. The operation of this first switch will hereinafter be explained in more detail.

In the case of normal weft insertion, an electrically conductive wet weft arrives at the position of the weft feeler 2 and comes in contact with both electrodes 2*a* and 2*b* so that electric current flows from the electric power source 1 to the amplifier 3 via the first switches 1 which is closed at the moment of weft detection (see discussion below).

The second switch $S_2$ is a normally closed switch which is made open by a cam 10 mounted to the crank shaft 11 of the loom at the instant when the weft comes to the position of the weft feeler 2 during weft insertion. This means that, even if a water jet flow comes to the position of the weft feeler 2 before the actual arrival of the weft, with the result that a normal signal (this is a false normal signal caused by electric discharge) is generated by the weft feeler 2, the normal signal flows to the ground but not to the integration circuit 4 since the second switch $S_2$ is still left closed at this early timing. At the instant when the weft arrives at the position of the weft feeler 2, the second switch $S_2$ is opened by the cam 10 on the crank shaft 11 and the normal signal from the weft feeler 2 is now applied to the integration circuit 4.

It is also possible to arrange the second switch $S_2$ between the amplifier 3 and the integration circuit 4. However in practice, this connection may cause malfunction of the integration circuit 4 which is caused by noises generated by operation of the switch $S_2$. For this reason, it is safer to arrange the switch $S_2$ as shown in the drawing. The integration circuit 4 subsequently accumulates signals applied thereto by the amplifier 3. Consequently, even when a normally inserted weft whips too much and temporarily gets out of contact with the weft feeler 2 to an extent such that electric discharge cannot span the gap, the integration circuit 4 prevents malfunction of the entire unit by utilizing the signals stored there before such a separation.

The signals from the weft feeler 2 are classified into three types. The first is a normal signal which is generated in the case of normal weft insertion. The second is a false normal signal which is generated by electric discharge even when weft insertion is abnormal. The third is an abnormal signal which is generated in the case of abnormal weft insertion. The level of signal becomes lower, or higher, in the described order. As a consequence, the integrated values becomes smaller, or larger, in the integrated order. These integrated values are applied to the input terminal a of the comparator 6.

The output of the potentiometer 5 is applied to the input terminal b of the comparator 6.

When the level of signal becomes lower in the order of normal, false normal and abnormal signals, the output from the potentiometer 5 is set, for example, to a value between the integrated value of the normal signals and the integrated value of the false normal signals. Then, upon comparison of the two values, i.e. the one from the integration circuit 4 and the other from the potentiometer 5, the comparator 6 generates a beating signal only when normal signals have been generated by the weft feeler 2.

In contrast, when the level of signal becomes higher in the order of normal, false normal and abnormal signals, an inverter is attached to the output side of the comparator 6 and the output from the potentiometer 5 is set, for example, to a value between the integrated value of the normal signals and the integrated value of the false normal signals. In this case, the comparator 6 may generate signals of, for example, binary "1" level in the case of false normal and abnormal weft insertions. But, this signal is inverted to binary "0" level. This corresponds, when the binary system is employed, to no generation of signal. In the case of normal weft insertion, a binary "0" level appears at the output terminal of the comparator 6, which is then inverted to binary "1" level. This corresponds to generation of a beating signal.

In either case, a beating signal is generated by the comparator 6 only when weft insertion has been carried out normally.

The timing signal generator 7 is, for example, made up of an electric power source PS and a normally open switch 53 connected thereto. This switch is closed by a cam 12 mounted to the crank shaft 11 of the loom at an instant between weft insertion and cloth-fell beating. Only at this instant, a timing signal is applied to the AND-gate 8 in order to enable the gate. Assuming that the weft feeler 2 has detected the presence of a previously inserted weft in the vicinity of the cloth-fell despite the present abnormal insertion, normal signals may be generated by the weft feeler 2 for accumulation at the integration circuit 4. The accumulated value may then be subjected to comparison at the comparator 6, which may thereupon apply a beating signal to the AND-gate 8. However, as the above-described switch is left open at this timing of the procedure, no timing signal from the generator 7 arrives at the AND-gate 8. As a consequence, the AND-gate 8 is disabled at this instant and no beating signal is passed to the drive control unit of the loom so that the running of the loom stops.

The operation of the first switch $S_1$ is as follows.

Weaving is usually carried out in a highly humid atmosphere and the weft feeler 2 is smothered with a great deal of steam and water drops. When high electric voltage is applied to the electrodes 2*a* and 2*b* under this highly humid condition, insulation between the electrodes 2*a* and 2*b* deteriorates quickly which leads to dielectric breakdown which causes malfunction of the weft feeler unit. In accordance with the present invention, the first switch $S_1$ is connected to the weft feeler 2 so that electric voltage should be applied to the weft feeler 2 only at the instant of weft detection. The position of switch $S_1$ is therefore controlled by an appropriate controller 13.

The value of electric voltage to be applied to the weft feeler should preferably be in a range from 900 to 3,000 V. In connection with this, however, number of twist and hydroscopic property of a weft vary depending on the type of the product and kind of the weft. When voltage of a fixed value is applied to the weft feeler regardless of variation in such factors, the value of electric current flowing to the amplifier 3 naturally varies and this variation in the incoming current necessitates adjustment of the amplification degree of the amplifier 3 and of the set value at the potentiometer 5 in reference to the type of the weft to be processed. In order to avoid this problem, it is advantageous to adjust the value of the voltage to be applied to the weft feeler in accordance with the type of the weft to be processed. This adjustment should preferably be carried out in a manner such that the input signal to be applied to the amplifier 3 should be kept at a constant value regardless of the type of the weft to be processed. This voltage adjustment well avoids the need of amplification degree change at the amplifier 3 depending on the type of the weft to be processed.

Although the foregoing description is directed to the example wherein water is used for the fluid, the present invention is well applicable to any cases wherein wefts are made conductive during insertion by fluid.

As is clear from the foregoing description, electric discharge between the pair of electrodes is fictionalized, in accordance with the present invention, to stable contact of the weft with the electrodes even when the contact is incomplete. As a consequence, even in the case of a high twist weft which is liable to cause incomplete contact or low signal level, normal insertion of weft can be reliably detected without fail and running of the loom can be continued as long as the weft insertion is carried out normally. This assures high rate of running efficiency of the loom.

Further, reduced unnecessary stoppage of the loom, which is otherwise caused by abnormal contact of the weft with the electrodes, greatly minimizes production of weaving defects such as weft stripes, thereby greatly enhancing quality of the products.

I claim:

1. Improved weft feeler unit for a fluid-jet loom, comprising:

a weft feeler made up of first and second electrodes which are mounted to the reed of said loom on the weft arrival side, and which are spaced from each other along the traveling path of a weft; and means for applying a voltage of 900 to 3,000 volts to said electrodes, which voltage is sufficiently high to establish a virtual electric connection between said electrodes and said weft even when there is a physical gap between said weft and either of said electrodes due to whipping of said weft as long as said weft has been normally inserted.

2. Improved weft feeler unit for a fluid-jet loom, comprising:

a weft feeler made up of first and second electrodes which are mounted to the reed of said loom on the weft arrival side, and which are spaced from each other along the traveling path of a weft;

an electric power source connected to said first electrode and supplying an electric voltage to said electrodes which is sufficiently high to establish a virtual electric connection between said electrodes and said weft even when there is a physical gap between said weft and either of said electrodes due to whipping of said weft as long as said weft has been normally inserted; and a detection circuit connected to said second electrode and issuing an operation signal for the drive control unit of said loom insertion in accordance with the condition of said weft insertion.

3. Improved weft feeler unit as claimed in claim 2, further including a normally open switch arranged between said first electrode and said electric power source, which is closed only when said weft comes to the position of said weft feeler.

4. Improved weft feeler unit as claimed in claim 2 or 3, in which said detection circuit includes:

a weft insertion signal generator connected to said second electrode and selectively generating one of an electric normal, a false normal and an abnormal weft insertion signal at every weft insertion depending on the condition of said weft insertion;

a normally closed switch arranged between said weft insertion signal generator and ground, which is opened only when said weft arrives at the position of said weft feeler;

a reference signal generator for generating a threshold electric signal at every weft insertion whose level is between those of said normal and false normal electric weft insertion signals; and a comparator circuit connected to said weft insertion signal and reference signal generators.

5. Improved weft feeler unit as claimed in claim 4 in which said detection circuit further includes:

a timing signal generator for generating an electric timing signal at every weft insertion at a timing between said weft insertion and cloth-fell beating; and an AND-gate connected to said comparator circuit and said timing signal generator, and generating said operation signal when enabled.

6. Improved weft feeler unit as claimed in claim 4 in which said weft insertion signal generator includes:

an amplifier connected to said second electrode; and an integration circuit connected to said amplifier.

7. Improved weft feeler unit for a fluid-jet loom, comprising:

a weft feeler made up of first and second electrodes which are mounted to the reed of said loom on the weft arrival side, and which are spaced from each other along the traveling path of a weft;

an electric power source connected to said first electrode and supplying an electric voltage to said electrodes which is sufficiently high to establish a virtual electric connection between said electrodes and said weft even when there is a physical gap between said weft and either of said electrodes due to whipping of said weft as long as said weft has been normally inserted; and a detection circuit connected to said second electrode and issuing an operation signal for the drive control unit of said loom insertion in accordance with the condition of said weft insertion, said detection circuit including:

(1) a weft insertion signal generator connected to said second electrode and selectively generating one of an electric normal, a false normal and an abnormal weft insertion signal at every weft insertion depending on the condition of said weft insertion;

(2) a normally closed switch arrangement between said weft insertion signal generator and ground, which is opened only when said weft arrives at the position of said weft feeler;

(3) a reference signal generator for generating a threshold electric signal at every weft insertion whose level is between those of said normal and false normal electric weft insertion signals; and (4) a comparator circuit connected to said weft insertion signal and reference signal generators.

8. Improved weft feeler unit as claimed in claim 7, in which said detection circuit further includes:

a timing signal generator for generating an electric timing signal at every weft insertion at a timing between said weft insertion and cloth-fell beating; and an AND-gate connected to said comparator circuit and said timing signal generator, and generating said operation signal when enabled.

9. Improved weft feeler unit as claimed in claim 7, in which said weft insertion signal generators includes:

an amplifier connected to said second electrode; and an integration circuit connected to said amplifier.

10. Improved weft feeler unit as claimed in claim 7, further including a normally open switch arranged between said first electrode and said electric power source, which is closed only when said weft comes to the position of said weft feeler.

* * * * *